US005550554A

United States Patent [19]

Erkocevic

[11] Patent Number: 5,550,554

[45] Date of Patent: * Aug. 27, 1996

[54] ANTENNA APPARATUS

[75] Inventor: Nedim Erkocevic, Nieuwegein, Netherlands

[73] Assignee: AT&T Global Information Solutions Company, Dayton, Ohio

[ * ] Notice: The term of this patent shall not extend beyond the expiration date of Pat. No. 5,420,599.

[21] Appl. No.: 409,556

[22] Filed: Mar. 23, 1995

Related U.S. Application Data

[63] Continuation of Ser. No. 219,578, Mar. 28, 1994, Pat. No. 5,420,599.

[30] Foreign Application Priority Data

May 6, 1993 [GB] United Kingdom ..... 9309368

[51] Int. Cl.[6] ..... H01Q 1/24

[52] U.S. Cl. ..... 343/828; 343/826; 343/702; 343/846; 343/876

[58] Field of Search ..... 343/828, 825, 343/826, 700 MS, 702, 846, 829, 848, 849, 876; 455/140; H01Q 1/24, 1/36, 23/00, 1/38

[56] References Cited

U.S. PATENT DOCUMENTS 4,750,000 6/1988 Schroeder ..... 343/900
5,420,599 5/1990 Erkocevic ..... 343/826

FOREIGN PATENT DOCUMENTS 56-27504 3/1981 Japan ..... 343/876

*Primary Examiner*—Donald T. Hajec
*Assistant Examiner*—Hoanganh Le
*Attorney, Agent, or Firm*—Paul J. Maginot

[57] ABSTRACT

The invention provides for antenna apparatus having antenna members extending parallel to a ground plane, which members are L-shaped and can be provided in advantageously miniaturized form. Two such antenna members can be provided on the same ground plane so as to achieve antenna diversity and a switch mechanism is provided for switching between the antenna member in a receive mode, and for switching to only one of the antenna members for operation of the apparatus in a transmit mode. The switch mechanism is arranged to ground a feed connector of the antenna member that is not selected for transmission or reception so as to render that antenna member passive.

12 Claims, 3 Drawing Sheets

ANTENNA APPARATUS

This is a continuation of Ser. No. 219,578, filed Mar. 28, 1994, now U.S. Pat. No. 5,420,599.

BACKGROUND OF THE INVENTION

The present invention relates to an antenna apparatus for use in a radio communication system.

Wireless communication is well known for communication over large distances and also where the communicating devices require a high degree of mobility. More recently, wireless communication has been employed for communication between personal computers (PCs) forming part of a local area network (LAN). To provide wireless connection to the LAN, the PC has to be equipped with an appropriate network interface card (NIC) and a radio modem which can be integrated into the NIC or connected to the NIC, by means of an appropriate cable. An antenna forms an integral part of the modem. Due to the use of small-size PCs, which have standard slots such as those proposed by the Personal Computer Memory Card Association (PCMCIA), reductions in the size of the NIC and modem, and thus the antenna, are required.

Known antenna apparatus such as the Plated Inverted-F Antenna (PIFA), which comprises a rectangular plate having a feed pin and ground pin connecting it to antenna circuitry and the ground plane respectively, is disadvantageous in that it is too large for use in applications of the above-mentioned nature and a simple reduction in the size of the rectangular plate leads to the significant degradation of performance in terms of operational bandwidth and/or gain. Also, the rectangular plate limits the area in which other RF components can be mounted since there is not enough space to mount the components beneath the rectangular plate.

SUMMARY OF THE INVENTION

It is an object of the present invention to provide an antenna apparatus that includes an antenna member which occupies a reduced amount of space while exhibiting a satisfactory gain and bandwidth.

According to the present invention, there is provided antenna apparatus including an antenna member extending parallel to a ground plane, a grounding connector connecting the antenna member to the ground plane and a feed connector connecting the antenna member to antenna circuitry, wherein the antenna member comprises first and second portions extending parallel to the plane and forming an L-shaped member.

Advantageously, the antenna member of the present invention can be formed from a sheet, the antenna member occupying less space than a known PIFA with the same gain and operational bandwidth.

Also, the antenna member is preferably of suitable dimensions such that two such members can be provided along with power-stage, and advantageously compact switching circuitry, in the same space as is occupied by a single PIFA of the same gain and bandwidth. The invention therefore also allows for the provision of advantageously compact receiver apparatus having antenna diversity.

BRIEF DESCRIPTION OF THE DRAWINGS

An embodiment of the present invention is described by way of example, with reference to the accompanying drawings in which.

DETAILED DESCRIPTION OF THE PREFERRED EMBODIMENT

Figure 1A:
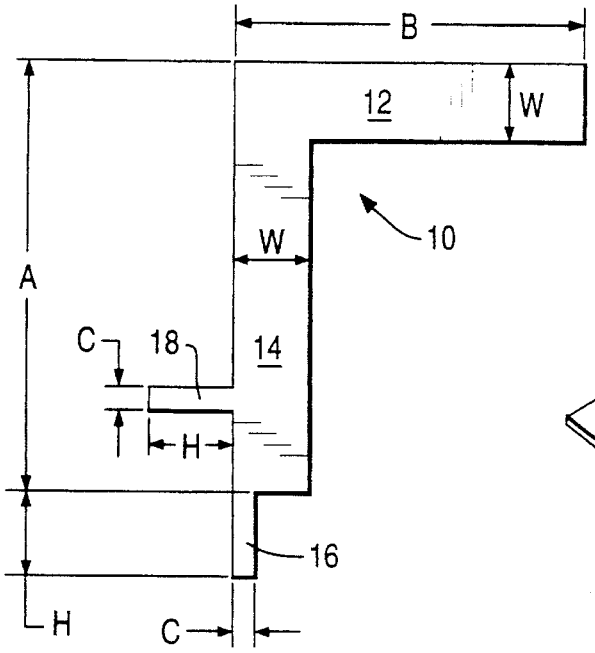
FIG. 1A is a plan/view of a blank for forming an antenna embodying the present invention.

While the invention is susceptible to various modifications and alternative forms, a specific embodiment thereof has been shown by way of example in the drawings and will herein be described in detail. It should be understood, however, that it is not intended to limit the invention to the particular form disclosed, but on the contrary, the intention is to cover all modifications, equivalents, and alternatives falling within the spirit and scope of the invention as defined by the appended claims.

As described further below, the antenna apparatus of the present invention can advantageously provide for an Active Antenna Diversity Module (AADM) that comprises two small antennae integrated together by way of switch mechanism for antenna selection and transmitter power stage connection. The AADM can be arranged to operate in the 915 MHz band and can be deployed as an integral part of the NIC or connected to the NIC by means of the appropriate cable for the wireless communication of PCs in a LAN.

Figure 1B:
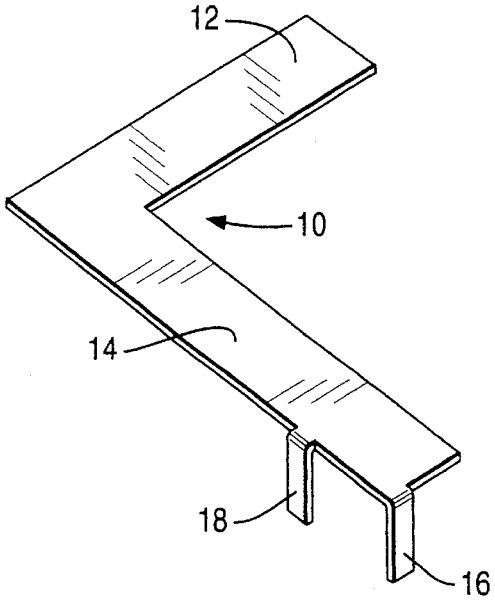
FIG. 1B is a perspective view of the blank of FIG. 1A once formed into an antenna.

FIGS. 1A and 1B illustrate an antenna 10 embodying the present invention with FIG. 1A showing a metal blank from which the antenna of FIG. 1B is formed. The antenna 10 has first 12 and second 14 portions forming an L-shape, which advantageously provides a good radiation source at its right-angled portion. At the end of the portion 14 remote from the portion 12 there is provided a grounding pin 16. Separated from the grounding pin 16 in the direction of the portion 12 is a feed pin 18. The antenna, as shown in FIG. 1B, can be formed by simply bending the pins 16, 18 on the blank of FIG. 1A at their junctions with the portion 14. Arrows A, B, C, H and W in FIG. 1A represent various dimensions of the antenna 10 and exemplary values are listed below to illustrate the compact size of the antenna 10.

A=47 mm

B=37 mm

C=2.5 mm

H=7 mm

W= 7 mm

As illustrated in FIG. 1B, the antenna 10 is in the form of an L-shaped IFA which effectively forms a leaky transmission line of a quarter wavelength. The length of the L-shape, i.e. the dimension A+B in FIG. 1A, is generally equal to a quarter of the wavelength of the communication signal although the length A+B may be varied so as to vary the electrical length of the antenna, for example if the antenna is positioned close to other circuitry. The operating bandwidth of the antenna 10 can be varied by altering the width W of the portions 12, 14 forming the L-shape, an increase in the width W leading to an increase in the bandwidth. A similar relationship exists between the height of the antenna 10 and the bandwidth. Fine tuning of the antenna is achieved by varying the width C of the grounding pin 16.

Figure 2:
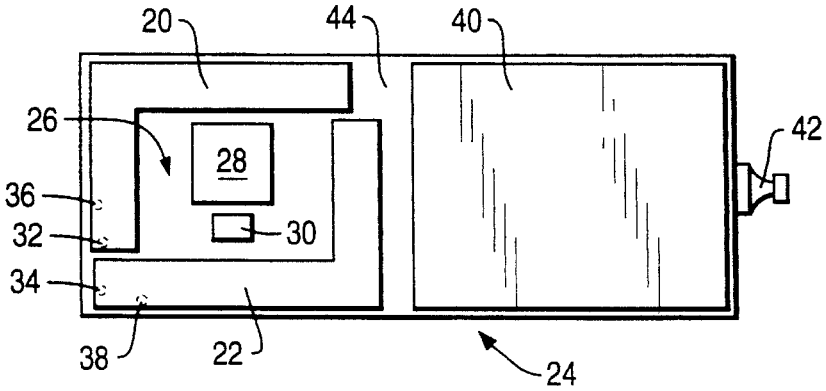
FIG. 2 is a plan view of a printed circuit board having antenna apparatus embodying the invention mounted thereon.
Figure 3:
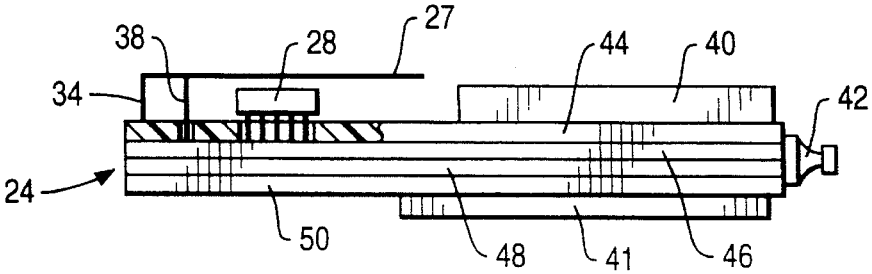
FIG. 3 is a sectional view of the printed circuit board of FIG. 2.

FIGS. 2 and 3 illustrate an AADM which employs two L-shaped IFAs 20, 22 mounted on a multi-layer printed circuit board (PCB) 24 that is arranged to form a radio modem for wireless communication between PCs in a LAN.

As seen in FIG. 2, the two antennae 20, 22 are mounted in an orthogonal relationship such that the extremities of the L-shaped portions are located adjacent each other. As such, the combined shape of the two antennae 20, 22 is substantially rectangular with a central open portion 26 in which is located transmission power stage circuitry 28 and a switch 30 for switching between transmission and reception modes and also for switching between the two antennae 20, 22 when in the reception mode. FIG. 2 also shows the location of the grounding pins 32, 34 and the feed pins 36, 38 of the antennae 20, 22. Additional RF circuitry (not shown) is also mounted on the PCB 24 within a shielding enclosure 40 and on the other side of the PCB 24. A connection mechanism 42 is also provided for further connection of the AADM to the NIC.

FIG. 3 is a diagrammatic sectional view of the PCB of FIG. 2, which for clarity shows the mounting connection of only one antenna 22 and the power stage 28. The shielding enclosure 40 is also shown in FIG. 3. As can be seen, the PCB 24 comprises four layers 44, 46, 48 and 50. The layer 44 forms the uppermost layer as seen in FIG. 3 over which the L-shaped antennae 20, 22 extend. The layer 44 forms a ground plane for the antennae 20, 22 which are mounted thereon, and electrically connected thereto, by their respective grounding pins 32, 34. The optimum mounting position for the antennae 20, 22 is at the edge of the ground plane 44. The feed pin 38 is insulated from, and passes through, the ground plane layer 44 and is electrically connected to the layer 46 in the PCB 24. The layer 46 serves for connection of the feed pins 36, 38 of the antennae 20, 22 to the switch 30 shown in FIG. 2, and also for connection of the power stage 28. The layer 46 also extends under the shielding enclosure 40 for connection to the circuitry enclosed therein. The layer 48 forms another ground plane which is located beneath the layer 46. The layer 50 provides for further connection between the components mounted on the PCB 24 and also allows for the surface mounting of components on the under surface of the layer 50 of the PCB 24 which are located in another shielding enclosure 41.

The L-shaped IFAs 20, 22 are advantageously smaller than known antennae, for example PIFAs, and advantageously also exhibit a generally omnidirectional radiation pattern and suitably wide bandwidth for a variety of communications applications. With particular reference to FIG. 2, the AADM (including the two L-shaped IFAs, the power stage and the switch) occupies the same space as a single PIFA. It can be appreciated that the L-shape of the antenna 20, 22 provides for such a compact construction while readily allowing for the mounting of each antenna 20, 22 at the edge of the ground plane 44.

The length A+B (see FIG. 1A) of the antennae 20, 22 in FIG. 2 would generally be the same for operation at the same frequency. However, in the illustrated AADM of FIG. 2, the length of the antenna 22 is less than the length of the antenna 20. This difference in length arises due to the positioning of the antennae 22 next to the shielding enclosure 40. The close proximity of the shielding enclosure 40 makes the antennae 22 appear electrically longer and so the actual length of the antenna 22 is decreased so that it remains tuned to the same frequency as the antenna 20. With both antennae 20, 22 tuned for operation at the same frequency, polarization diversity between the antennae 20, 22, can be particularly achieved by the orthogonal positioning of the two antennae 20, 22. This antenna diversity helps cope with multipath fading of a received signal, whereby the signals received by each antenna can be compared and the antenna having the better reception can be selected.

Figure 4A:
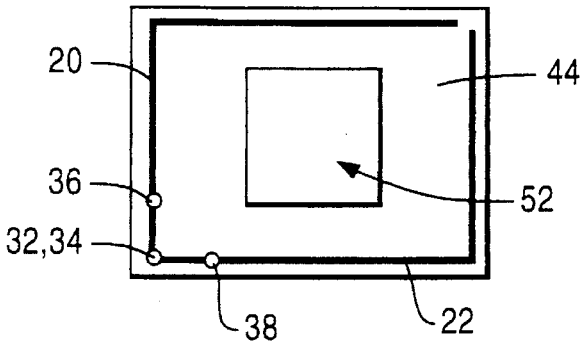
FIGS. 4A and 4B are diagrammatic representations showing the connection between components of the apparatus of FIGS. 2 and 3.
Figure 4B:
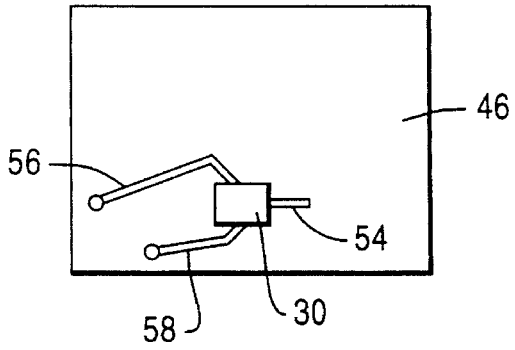

A switching mechanism 30 is provided for switching between the two antennae 20, 22 when the apparatus is in a receiving mode and the invention advantageously employs the same switching mechanism for switching between the receiving mode and a transmitting mode. FIGS. 4A and 4B are diagrammatic representations of the upper two layers 44, 46 of the multilayer PCB 24 of FIG. 3. For simplicity, the two antennae 20, 22 are illustrated with a common ground pin 32, 34 since the ground pins of the separate antennae 20, 22 are connected to the same ground plane. FIG. 4A also illustrates the feed pins 36, 38 for each antenna 20, 22, and also an aperture 52 in the ground plane 44 through which the power stage 28 and the switch 30 are connected to the layer 46. FIG. 4B illustrates the location of the switch 30 on the layer 44 along with a connector 54 for feeding the signal received by the antennae 20, 22 to receiver circuitry, and connectors 56, 58 to the feed pins 36, 38 of the antennae 20, 22. The connectors 54, 56, 58 comprise microstrip or strip lines formed on the layer 46. The antenna diversity of the present invention is achieved by the placement of the two L-shaped antennae 20, 22 on the same ground plane in a manner that renders their responses uncorrelated. Generally, when two antennae such as 20, 22 are placed close to each other, they tend to be highly coupled and this leads to a decrease in the diversity-effectiveness. This problem is overcome in the present invention by the provision of a switch 30 which is arranged to selectively connect the feed pin of one of the antennae 20, 22 to ground and so cause that antenna to behave as a passive resonant circuit tuned to a different frequency from the frequency of operation of the antenna apparatus. Thus, the passive antenna has only a minor influence on the operation of the active antenna. This switching operation is further described with reference to FIGS. 4A and 4B in which the antenna 20 is to be switched into a passive mode so as to minimize its effect on the active receiving antenna 22. The switch 30 connects the feed pin 36 of the antenna 20 to ground by way of the connector 56. The antenna 20 can then be thought of as two parts. Firstly, that part between the feed pin 36 and the ground pin 32 which forms a short-circuited inductive load due to the grounding of the feed pin 36 and ground pin 32, and secondly the remainder of the antenna 20 which comprises a transmission line slightly shorter than a quarter wavelength which acts as a capacitive load. Thus, the antenna 20 with its feed point 36 grounded represents a parallel resonant L.C. circuit which is tuned to a different operating frequency from the active antenna. The switch 30 is arranged for operation such that it is possible to switch between two antennae 20, 22 in a receiving mode and to switch to only one 20 of the antennae for operation in a transmission mode. Whenever the antenna 20 is switched for transmission, or either one of the antennae 20, 22 is switched for reception, the other of the two antennae is switched into a passive state. As mentioned above, one advantageous way of performing such a switching operation is to ground the feed pin of the antenna which is to become passive.

A particularly advantageous switch arrangement for achieving the switching between the two antennae 20, 22 in the receiving mode, and also between the receiving mode and transmission mode, is now described in which the switching is achieved by way of one Single Pole Dual Terminal (SPDT) switch 30.

Figure 5:
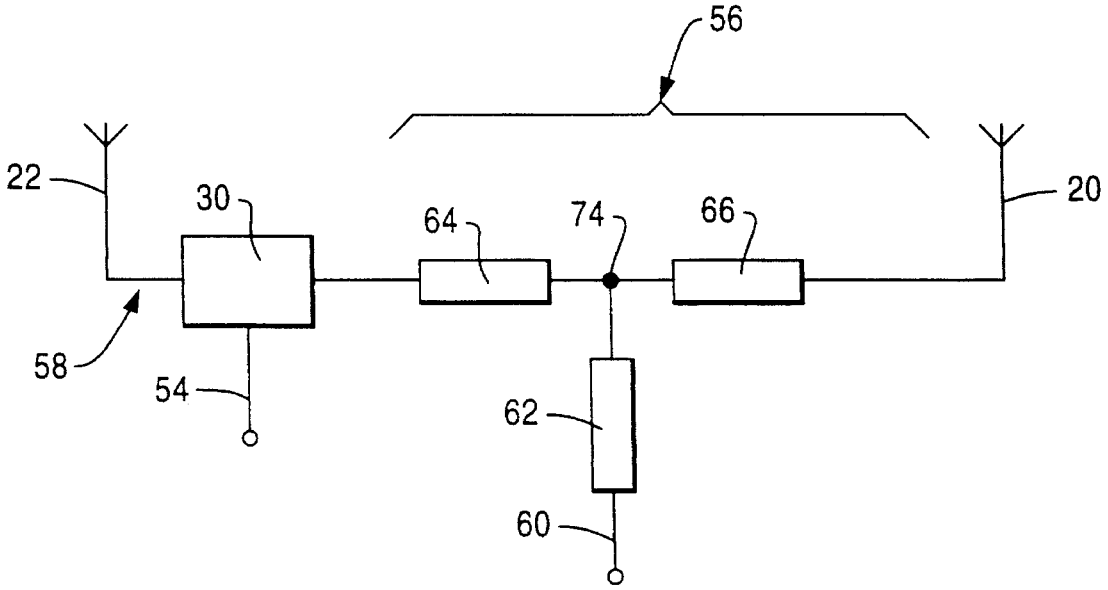
FIG. 5 is a diagrammatic representation of one form of switching apparatus for use in the present invention.

FIG. 5 is a diagrammatic representation of the switch arrangement of FIG. 4B and shows the connection of the switch 30 to the antennae 20, 22 by way of the connectors 56, 58. As mentioned above, the antenna 22 is only arranged for reception whereas the antenna 20 is arranged for transmission or reception. As such, a connector 60 is provided for connection of the antenna 20 to the transmitter power stage 28 for operation in the transmission mode. The connectors 56, 60 include impedance transformers 62, 64, 66. The transformers 64, 66 in the connector 56 form quarter-wave stubs and the transformer 62 serves to increase the input impedance seen at the output of the power stage 28.

Figure 6A:
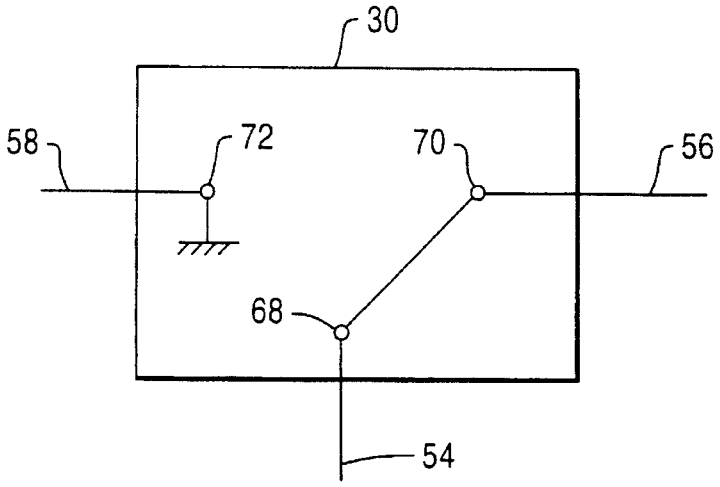
FIGS. 6A–6C illustrate the switching modes of the switch of FIG. 5.
Figure 6B:
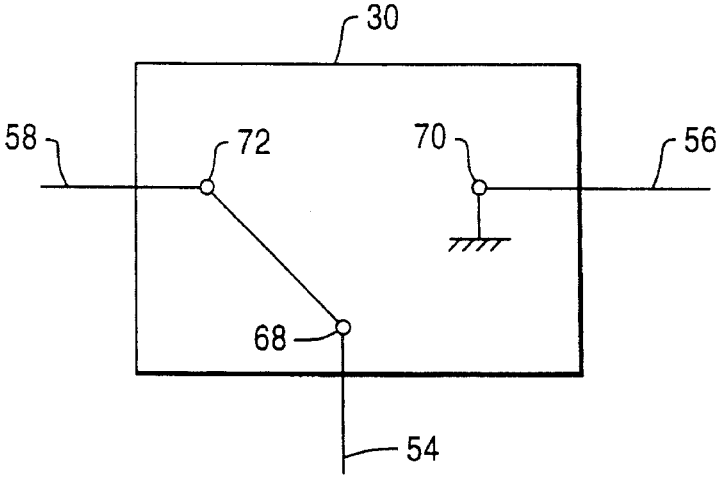
Figure 6C:
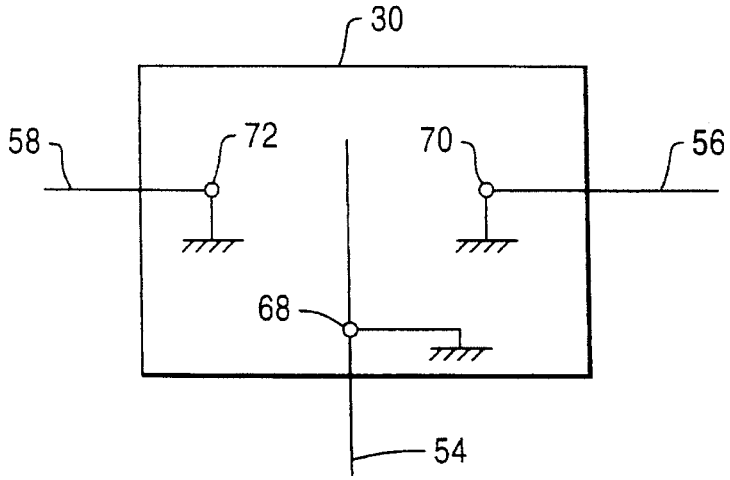

As previously mentioned, the switching between transmit and receive modes and the switching between each antennae 20, 22 in the receive mode is advantageously carried out by one SPDT switch. To achieve these two switching functions in the same SPDT switch, the switch 30 makes use of its two specified switching states and also an unspecified state. This is illustrated in FIGS. 6A–6C which only show the schematic form of the switch 30 which, for example, comprises an Alpha ASCO2R2 SPDT GaAs switch having two control inputs (not shown) for selectively connecting a terminal 68 to either of terminals 70, 72. As such, the antennae 20, 22, which are connected to the terminals 70, 72 by means of the connectors 56, 58 respectively, can be connected to the connector 54 via the terminal 68 so as to perform the selective switching between the two antennae 20, 22 in the receive mode. These two specified switch states are illustrated in FIGS. 6A and 6B and result from applying 0 volts to one of the control inputs and –5 volts (or 5 volts if the switch is floated) to the other of the control inputs of the switch. As previously mentioned, an unspecified state of the switch 30 is also employed and this state arises when both control inputs are connected to 0 volts and is illustrated in FIG. 6C. As can be seen, the terminal 68 is not connected to either of the terminals 70, 72, and so each of the connectors 54, 56, 58 is grounded at the switch 30. In this state, the antenna apparatus can function in a transmit mode in which only the antenna 20 is in operation.

As can be seen, for example in FIG. 6A, the switch 30 meets the criteria that when one antenna 20 is connected to the connector 54, via the terminal 70, for operation as the receiving antenna, the feed pin of the other antenna 22 is grounded by way of the connector 58 and terminal 72. However, in FIG. 6B, with the antenna 22 connected via the connector 58 and terminal 72 for operation as the receiving antenna, the antenna 20 will not be fully grounded, this is due to the fact that terminal 70 is grounded and connected to antenna 20 through the half wavelength stub formed by the impedance transformers 64, 66 shown in FIG. 5. The connection of the power stage 28, by way of the connector 60 and impedance transformer 62, to the middle of the half wavelength stub 64, 66 can be neglected due to its relatively high input impedance as seen through the impedance transformer 62. In practice, this relatively high value is in the region of 700 ohms and causes an additional insertion loss of 0.3 dB from the antenna 20 to the terminal 70 when the antenna 20 is used for reception.

As noted above, only the antenna 20 is used for transmitting signals from the apparatus. In the transmit mode, both terminals 70, 72 in the switch 30 are grounded so that the antenna 22 is off, i.e. passive, while the impedance transformer 64 is short-circuited at its end adjacent the terminal 70 and the power stage 28 is connected to the antenna 20 by way of impedance transformers 62, 66. As such, the input impedance of the impedance transformer 64 measured at the junction 74 with the impedance transformers 62, 66 is approximately 1 kohm, which causes only a small additional insertion loss of 0.3 dB from the power stage 28 to the antenna 20.

In general, if the impedance transformers 62, 64, 66 have a 50 ohm characteristic impedance and an optimal electrical length, the operating parameters of the switching circuitry including the switches and impedance transformers 62, 64, 66 would be as follows:

0.6 dB:

Insertion loss in the transmit mode which comprises 0.3 dB due to the shortened stub 64 forming a dummy load at the junction 74, and 0.3 dB attenuation along the path formed by impedance transformers 62 and 66.

0.6 dB and 1.2 dB:

Insertion loss in the receive mode using antenna 22, 20 respectively. When antenna 20 is used, it is assumed that the insertion loss of the switch 30 in its ON state is 0.6 dB, the loss due to the power stage as a dummy load at 74 is 0.3 dB and the attenuation along the path formed by transformers 64, 66 is 0.3 dB.

It is particularly advantageous that the switching between the receive mode and transmit mode performed by the switch 30 occurs through the quarter wavelength stub 64, because the switch 30 is then positioned at the point of the minimum voltage of the standing wave and so clipping of the switch 30 does not occur. If the output from the transmitter power stage 28 is 27 dBm, no more than 15.2 dBm arrives at the switch 30 and advantageously this is much less than the switch's maximum power handling capacity. Thus, in the transmit mode, most of the transmission power flows along the path of the impedance transformers 62, 66 and to the antenna 20, while only a small fraction of the power flows to the switch 30 since it is grounded at the terminal 70 end of the quarter wavelength stub formed by the impedance transformer 64. The switch 30 can therefore be employed with transmitter power which exceeds its maximum capacity by up to 10 dB. It is therefore important that the electrical length of the impedance transformer 64 is as close to a quarter wavelength as possible.

A further advantage in positioning the switch 30 at the end of the quarter wavelength stub 64 is that it can be controlled by way of a low DC voltage. This is particularly important for use with portable devices employing only a 3–5 volt DC supply.

The invention is not restricted to the details of the foregoing embodiment. For example, two antennae of closer, or the same, dimensions could be employed if some of the circuitry mounted on the upper surface in FIG. 3 were mounted on the lower surface, and other mechanism for switching the antenna between active and passive modes can be provided.

What is claimed is:

1. An antenna apparatus for use with a ground plane and an antenna circuit including receiver circuitry, comprising:

a first antenna member;

a grounding connector for connecting said first antenna member to the ground plane;

a feed connector for connecting said first antenna member to the antenna circuit;

a second antenna member;

a second grounding connector for connecting said second antenna member to the ground plane;

a second feed connector for connecting said second antenna member to the antenna circuit; and a switch electrically interposed between said first antenna member and said second antenna member, said switch for electrically connecting said first antenna member to the receiver circuitry when said first antenna member is selected to receive, for electrically connecting said second antenna member to the receiver circuitry when said second antenna member is selected to receive, and for electrically isolating the receiver circuitry from said first and second antenna members when said first antenna member is selected to transmit.

2. The antenna apparatus according to claim 1, wherein said first antenna member has a first portion and a second portion each extending parallel to the ground plane and positioned relative to each other so as to form a substantially L-shaped member.

3. The antenna apparatus according to claim 2, wherein said first antenna member is formed into the substantially L-shaped member from a metal sheet.

4. The antenna apparatus according to claim 1, wherein said first antenna member and said second antenna member are each able to operate in a receive mode, but only said first antenna member is able to operate in a transmit mode.

5. The antenna apparatus according to claim 4, wherein said switch is arranged to cause the second antenna member to be in a passive state when the first antenna member is operating in the receive mode.

6. The antenna apparatus according to claim 1, wherein said switch comprises a single-pole-double-terminal switch.

7. An antenna apparatus for use with an antenna circuit having receiver circuitry, comprising:

a first antenna;

a second antenna;

a switch for selecting between (1) a first mode wherein said first antenna is electrically connected to the receiver circuitry so as to operate in a receiving mode while said second antenna is grounded, (2) a second mode wherein said second antenna is electrically connected to the receiver circuitry so as to operate in a receiving mode while said first antenna is grounded, and (3) a third mode wherein said first and second antennas are electrically isolated from the receiver circuitry, said first antenna to operate in a transmitting mode while said second antenna is grounded.

8. The antenna apparatus of claim 7, wherein:

in the first mode, the second antenna is caused to behave as a passive resonant circuit which is tuned to a frequency that is different from the frequency of operation of the first antenna; and in the second mode, the first antenna is caused to behave as a passive resonant circuit which is tuned to a frequency that is different from the frequency of operation of the second antenna.

9. The antenna apparatus of claim 8, wherein:

said first antenna includes a grounding connector electrically connected to a ground plane; and said second antenna includes a grounding connector electrically connected to the ground plane.

10. The antenna apparatus of claim 9, wherein:

said first antenna further includes a feed connector electrically connectable to the antenna circuit; and said second antenna further includes a feed connector electrically connectable to the antenna circuit.

11. The antenna apparatus of claim 8, wherein:

said first antenna includes a first portion and a second portion positioned relative to each other so as to form a substantially L-shaped member; and said second antenna includes a first portion and a second portion positioned relative to each other so as to form a substantially L-shaped member.

12. The antenna apparatus according to claim 7, wherein said switch comprises a single-pole-double-terminal switch.

* * * * *